United States Patent [19]

Rosenberg et al.

[11] 3,967,351

[45] July 6, 1976

[54] CLASP

[75] Inventors: Melvin Rosenberg; Sheldon Brickner, both of New York, N.Y.

[73] Assignees: Melvin Rosenberg; Morris Schwartz, both of North Woodmere, N.Y.

[22] Filed: Apr. 18, 1975

[21] Appl. No.: 569,259

[52] U.S. Cl. ..... 24/230 SC; 24/201 A; 24/201 HE; 24/230 F

[51] Int. Cl.[2] ..... A44B 17/00

[58] Field of Search.... 24/201 HE, 230 SC, 230 SL, 24/230 F, 230 CF, 230 R

[56] References Cited

UNITED STATES PATENTS

| | | | |
|---|---|---|---|
| 941,542 | 11/1909 | Simpson | 24/230 |
| 1,151,333 | 8/1915 | Baruch | 2/221 |
| 1,371,210 | 3/1921 | King | 24/230 |
| 1,499,428 | 7/1924 | Wagner | 24/230 |
| 2,137,920 | 11/1938 | Manickas | 24/230 |
| 2,266,074 | 12/1941 | Rauer | 24/230 |
| 2,908,953 | 10/1959 | Anderson | 24/49 |
| 2,964,937 | 12/1960 | Lautin | 70/456 |
| 3,251,110 | 5/1966 | Hedu | 24/230 |
| 3,844,000 | 10/1974 | Hedu | 24/230 SC |
| 3,848,299 | 11/1974 | Gray | 24/230 SC |

FOREIGN PATENTS OR APPLICATIONS

| | | | |
|---|---|---|---|
| 676,151 | 11/1929 | France | 24/230 SC |
| 180,611 | 1/1907 | Germany | 24/230 SC |

*Primary Examiner*—Roy D. Frazier
*Assistant Examiner*—Robert W. Gibson, Jr.
*Attorney, Agent, or Firm*—McAuley, Fields, Fisher & Goldstein

[57] ABSTRACT

A clasp for an article of jewelry or the like of the type having a latch member engageable with a keeper member for fastening the clasp. The latch member has a resiliently depressible hook portion disposed for movement from a normally extended position to a flexed position. The keeper member comprises a housing having an open end through which the hook portion of the latch member may be inserted or withdrawn when the hook portion is in its flexed position. The housing also includes an apertured wall located to receive the hook portion for engaging the latch member within the housing and permitting the hook portion to move to its extended position for fastening the clasp. The hook portion extends beyond the aperture in the housing wall when the latch member is engaged within the housing, and terminates in an end portion overlying an edge portion of the housing wall forming the periphery of said aperture when the latch member is moved in the direction of withdrawal from the housing. The overlying relation of the hook end portion to the housing wall prevents the hook portion from moving to the flexed position to inadvertently unfasten the clasp. At such time as it is desired to unfasten the clasp, the latch member is moved in the direction of insertion in said housing to align said hook portion with said aperture and the hook portion is then moved to its flexed position to permit the latch member portion to be withdrawn through the open end of the housing.

12 Claims, 25 Drawing Figures

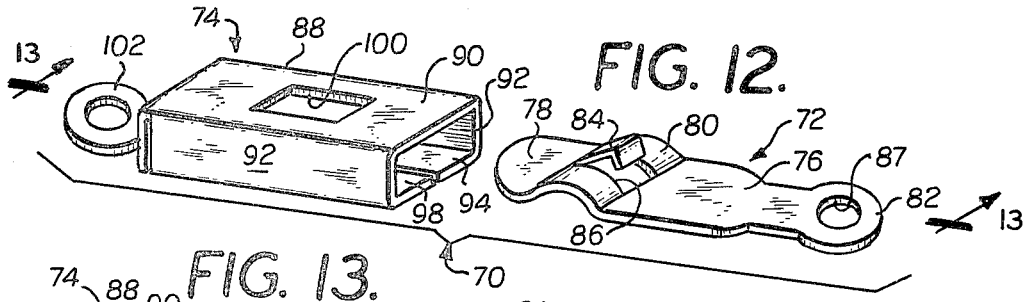
FIG. 12.
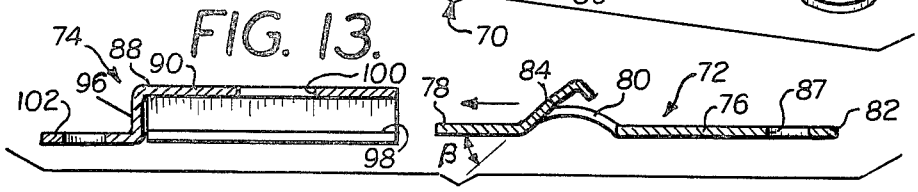
FIG. 13.
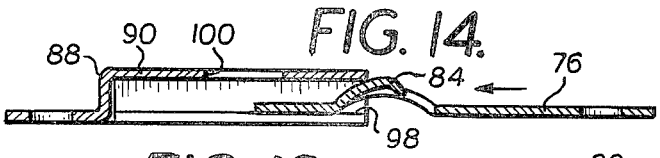
FIG. 14.
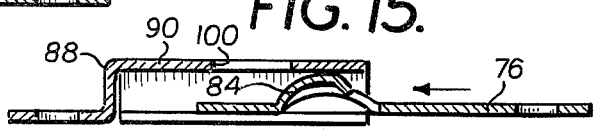
FIG. 15.
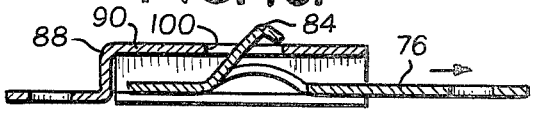
FIG. 16.
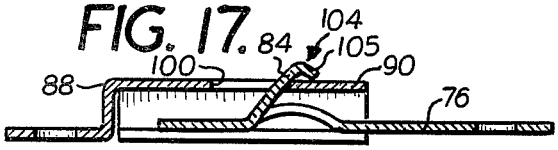
FIG. 17.
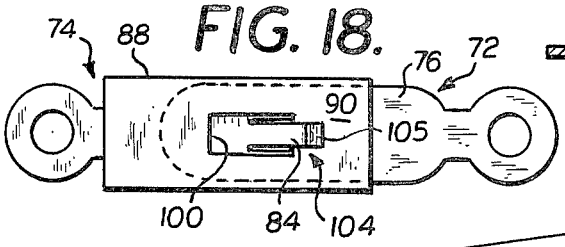
FIG. 18.
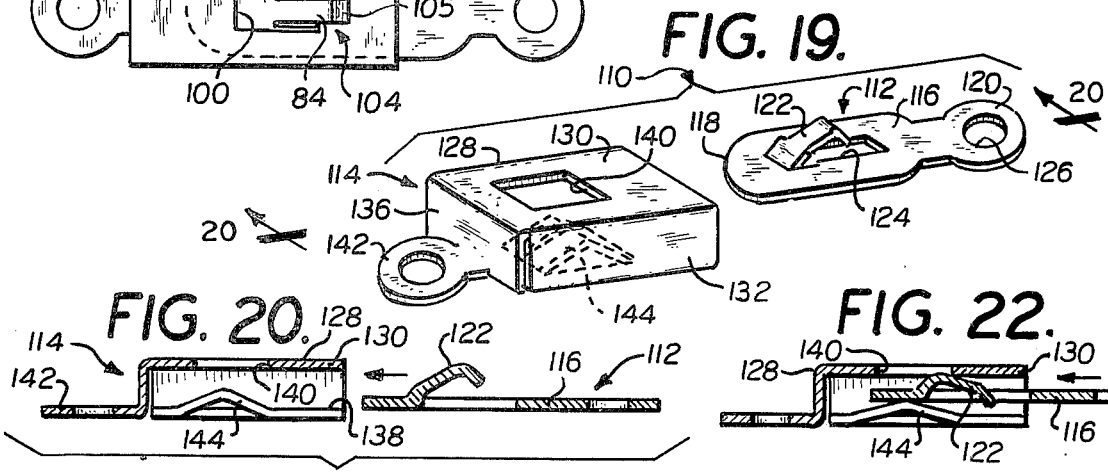
FIG. 19.
FIG. 20.
FIG. 22.
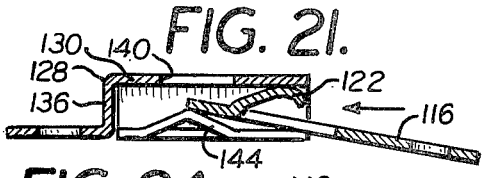
FIG. 21.
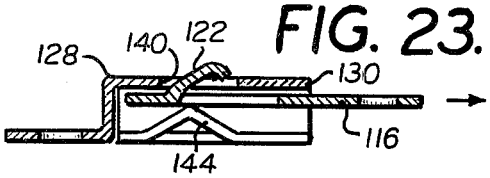
FIG. 23.
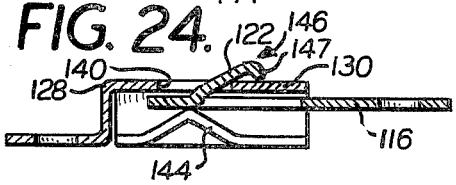
FIG. 24.
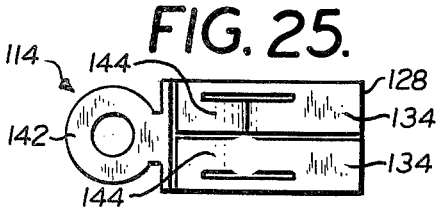
FIG. 25.

CLASP

BACKGROUND OF THE INVENTION

1. Field of the Invention

This invention relates generally to a clasp for detachably holding two articles together, and more particularly, to a clasp for an article of jewelry or the like of the type having a latch member engageable with a keeper member for fastening the clasp.

2. Description of the Prior Art

Heretofore, many forms of clasps have been proposed wherein a latch member is formed having a resilient tongue portion disposed to interengage with an accommodating recess or opening formed in a wall surface of a keeper member or housing. The uses of such clasps have become quite common in connection with garments, jewelry or key chains, or whenever it is desired to detachably hold two articles together. Illustrative examples of such clasps are shown and described in U.S. Pat. No. 1,371,210 (King) and U.S. Pat. No. 3,251,110 (Hedu) wherein the resilient tongue portion of each latch member projects outwardly from the upper surface of said member. Additional examples of such clasps are noted in U.S. Pat. No. 2,266,074 (Rauer) and U.S. Pat. No. 2,908,953 (Anderson) wherein the resilient tongue portion of each clasp member projects outwardly from the side edges of said member.

Each of the above constructions share in a common disadvantage in that it is often a relatively simple matter to inadvertently depress the tongue portion and thereby permit the latch member to disengage from the housing without any knowledge on the part of the person wearing the clasp. It will be appreciated that the unknowing disengagement of the clasp often results in the loss of the article or jewelry connected to the separable members of the clasp.

It has also been proposed to provide a fastener which incorporates a protective guard to prevent the tongue portion from accidentally becoming disengaged from the keeper member. An illustrative example of such a fastener is shown and described in U.S. Pat. No. 941,542 (Simpson) which provides a leaf spring normally biased in contact with the tongue portion to prevent the accidental disengagement of the fastener members. However, the structure and operation of this kind of fastener are not suitable for smaller and thinner sized clasps of the kind usually employed in articles of jewelry.

Accordingly, an object of the present invention is to provide an improved jewelry clasp which substantially reduces the likelihood of the latch member becoming inadvertently or accidentally disengaged from the keeper member or housing.

Another object and feature of the present invention is to provide a clasp for articles of jewelry or the like which is relatively simple in construction and economical to manufacture.

A further object, feature and advantage of the present invention is to provide a clasp having improved locking or retaining means for securely fastening the separable members of the clasp.

SUMMARY OF THE INVENTION

The clasp of the present invention is of the type having a latch member engageable with a keeper member for fastening the clasp. The latch member has a resiliently depressible hook portion disposed for movement from a normally extended position to a flexed position. The keeper member comprises a housing having an open end through which the hook portion of the latch member may be inserted or withdrawn when the hook portion is in its flexed position. The housing also includes an apertured wall located to receive the hook portion upon insertion thereof for engaging the latch member within the housing and permitting the hook portion to move to its extended position for fastening the clasp.

The hook portion is sized to extend beyond the aperture in the housing wall when the latch member is engaged within the housing. The hook portion also terminates in an end portion overlying an edge portion of the housing wall forming the periphery of said aperture when the latch member is moved in the direction of withdrawal from the housing. The overlying relation of the hook end portion to the housing wall when the clasp members are engaged and under tension serves to prevent the hook portion from moving to its flexed position to inadvertently or accidentally unfasten the clasp.

At such time as it is desired to unfasten the clasp, the hook portion is aligned with the aperture in the housing wall and then moved to its flexed position to disengage the latch member from the housing and perimt the flexed hook portion to be withdrawn through the open end of the housing.

Additional features and advantages of the present invention will become more apparent from a consideration of the following detailed description when taken in conjunction with the accompanying drawings.

FIG. 12 is a prospective view of another clasp constructed in accordance with the present invention, and illustrating the separable members of the clasp prior to interengagement thereof;

FIG. 13 is a sectional view taken through line 13–13 of FIG. 12;

FIG. 14 and 15 are views similar to FIG. 13 illustrating the resiliently depressible hook portion of the latch member successively moved to its flexed position for insertion of said latch member within the housing;

FIG. 16 is a view similar to FIG. 15 illustrating the latch member engaged within the housing and the hook portion moved to its extended position for fastening the clasp;

FIG. 17 is a view similar to FIG. 16 illustrating the hook end portion overlying a surface portion of the housing wall when the latch member is moved in the direction of withdrawal from the housing and thereby preventing movement of said hook portion to its flexed position;

FIG. 18 is a top plan view of the fastened clasp illustrated in FIG. 17;

FIG. 19 is a perspective view of another clasp constructed in accordance with the present invention, and illustrating the separable members of the clasp prior to interengagement thereof;

FIG. 20 is a sectional view taken through line 20–20 of FIG. 19;

FIGS. 21, 22, 23 and 24 are views corresponding to FIGS. 14, 15, 16 and 17, respectively, substituting therein the embodiment of the latch member and the housing illustrated in FIG. 19; and FIG. 25 is a bottom plan view of the embodiment of the housing member illustrated in FIG. 19.

DESCRIPTION OF THE PREFERRED EMBODIMENTS

Figure 1:
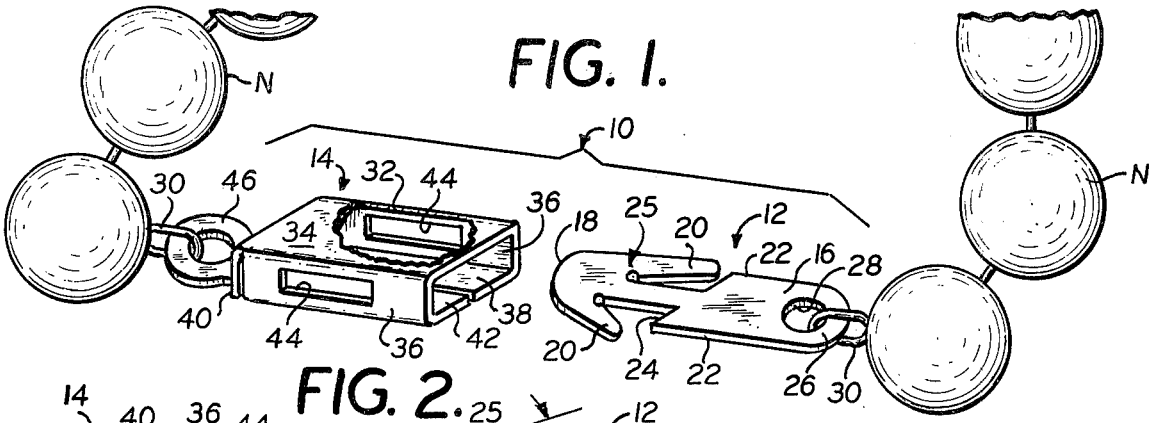
FIG. 1 is a perspective view, partly in section and with parts broken away, of the clasp constructed in accordance with the present invention, and illustrating the separable members of the clasp prior to interengagement thereof.

Referring to the drawings, and more particularly to FIGS. 1–7, numeral 10 represents one embodiment of the clasp constructed in accordance with the present invention. Clasp 10 is illustrated as detachably holding together the opposite ends of a necklace N; however, it will be appreciated that the clasp can also be used with other articles of jewelry, such as a bracelet, or whenever it is desired to detachably hold two articles together.

Clasp 10 is of the type having a latch member 12 engageable with a keeper member 14 for fastening the clasp. Latch member 12 represents a thin latch plate 16 manufactured by a stamping operation and constructed of a metal having a thickness in the range between 0.004 inches (0.010 cm). and 0.006 inches (0.015 cm). The length of latch plate 16 extends between 0.030 inches (0.76 cm.) and 0.50 inches (1.27 cm.), and its width is in the range between 0.09 inches (0.23 cm.) and 0.15 inches (0.38 cm.). It is to be noted that the above dimensions are illustrative of the preferred construction and are not to be deemed limitations on the invention. It is clear, however, that latch plate 16 is relatively thin and of lightweight construction.

Figure 6:
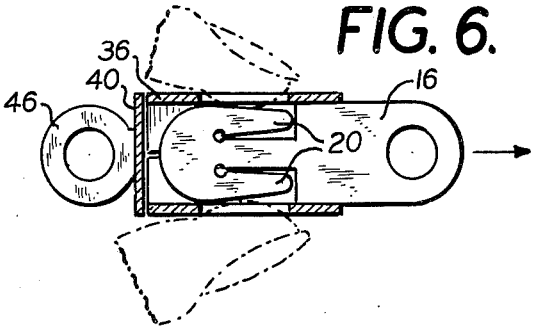
FIG. 6 is a view similar to FIG. 4 illustrating the position of the members for unfastening of the clasp wherein the hook portions are moved to their flexed positions to disengage the latch member from the housing.
Figure 7:
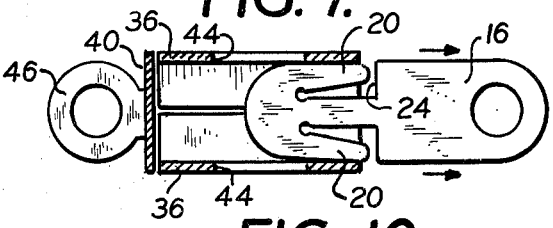
FIG. 7 is a view similar to FIG. 6 illustrating the flexed hook portions being withdrawn from the housing to unfasten the clasp.
Figure 8:
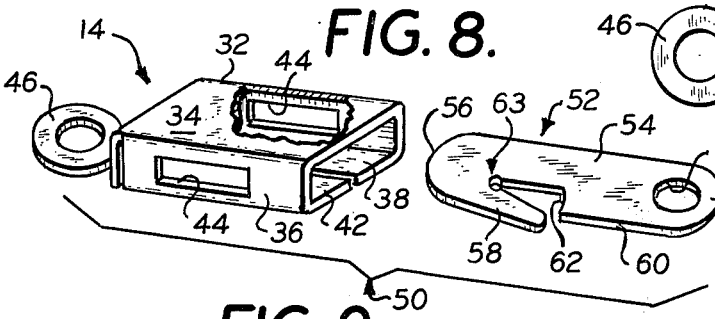
FIG. 8 is a view similar to FIG. 1 illustrating another embodiment of the latch member having only one resiliently depressible hook portion projecting outwardly from a side edge of the latch member.

Latch plate 16 is formed having a forwardly insertable end portion 18 and a pair of resiliently depressible hook portions 20, 20 each projecting outwardly from the plate and extending rearwardly of end portion 18. Hook portions 20, 20 are located in the plane of plate 16, and each project outwardly beyond a side edge 22, 22 of said plate when said hook portions are in their normally extended positions as illustrated in FIGS. 1, 2, 4 and 5. The angular relationship $\alpha$ of hook portions 20, 20 to side edges 22, 22 are in the range between 7° and 17°. Hook portions 20, 20 are each disposed for movement from a normally extended position to a flexed position in the direction of plate 16 as illustrated in FIGS. 3, 6 and 7. In this regard, the side edges 22, 22 of plate 16 are each formed with a recess portion 24, 24 to define a neck region having side edges which merge with the respective inner edges of hook portions 20, 20. As arcuate cutout, represented by numeral 25, is formed at the juncture of said neck and each of said hook portions to facilitate movement of said hook portions to their flexed positions within recess portions 24, 24. The rearwardly end portion 26 of plate 16 is formed with a through opening 28 for receiving a link 30 or other suitable fastener for connecting latch member 12 to one end of necklace N in conventional manner.

Keeper member 14 represents a thin walled housing 32 similarly manufactured by a stamping and bending operation, and constructed of a metal having a thickness in the range between 0.004 inches (0.010 cm.) and 0.006 inches (0.015 cm.). The overally length of housing 32 is approximately 0.30 inches (0.76 cm.), its width is approximately 0.11 inches (0.28 cm.) and its height or depth is approximately 0.05 inches (0.13 cm.). Here, again, the above dimensions are illustrative and are not to be deemed limitations on the invention.

The material used to manufacture the housing 32 is bent to form a top wall 34, a pair of opposed side walls 36, 36, a split bottom wall 38, a rear wall 40 and an open front end 42 for receiving the latch member 12 in the manner hereinafter described. Housing side walls 36, 36 are each formed having an elongated aperture or opening 44 having suitable dimensions and located to receive a separate one of the hook portions 20 for engaging the latch plate 16 within housing 32. The rear wall 40 terminates in an annular ring-like portion 46 projecting outwardly from wall 40 in the direction opposite to front end 42, and in a plane substantially parallel to the plane of top wall 34. Ring portion 46 receives another one of the necklace links 30 for connecting keeper member 14 to the other end of necklace N in conventional manner.

Figure 2:
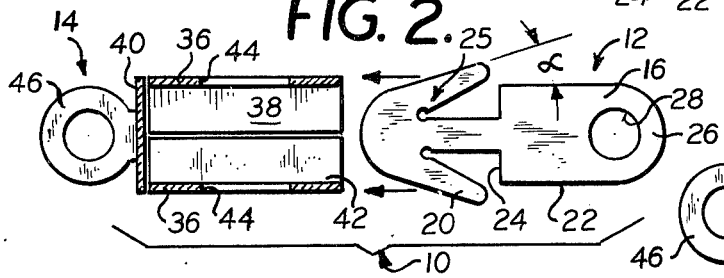
FIG. 2 is a top plan view of the clasp illustrated in FIG. 1 with the housing shown in section to more clearly illustrate the interengagement of the separable members as represented in FIGS. 3–7.
Figure 3:
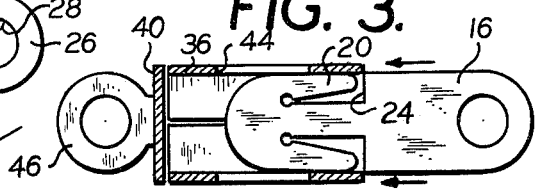
FIG. 3 is a view similar to FIG. 2 illustrating the resiliently depressible hook portions of the latch member moved to their flexed positions for insertion of said latch member within the housing.
Figure 4:
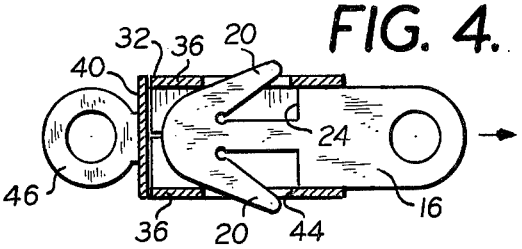
FIG. 4 is a view similar to FIG. 3 illustrating the latch member engaged within the housing and the hook portions moved to their extended positions for fastening the clasp.

In fastening the clasp 10, the forward end portion 18 of latch plate 16 is moved in the direction of the arrow shown in FIG. 2 and inserted into the open front end 42 of the housing 32. In this regard, the open end of the housing has a smaller dimension than the corresponding dimension of the latch plate when the hook portion is in its extended position. Thus insertion of latch plate 16 within housing 32 causes the normally extended hook portions 20, 20 to be moved toward their flexed positions within the recessed portions 24, 24 of plate 16 as shown in FIG. 3. The continued insertion of plate 16 within housing 32 permits the flexed hook portions 20, 20 to be received within the apertured side walls 36, 36 of the housing whereupon the hook portions 20, 20 are then free to move back to their normally extended positions, as shown in FIG. 4, for fastening the clasp. It will be appreciated that the configuration of hook portions 20, 20 and the dimensions of side wall apertures 44, 44 are such that the terminal ends of said hook portions 20, 20 each extend beyond the associated side wall aperture 44 when latch plate 16 is engaged within housing 32. Thus, when latch member 12 is now moved in the direction of withdrawal from keeper member 14, latch plate 16 is prevented from being completely withdrawn from housing 32 by means of the extended hook portions 20, 20 which project beyond the side wall apertures 44, 44.

Figure 5:
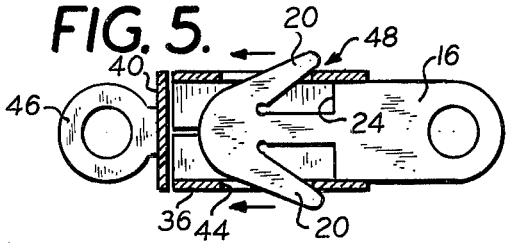
FIG. 5 is a view similar to FIG. 4 illustrating each the hook end portion overlying a surface portion of the housing wall when the latch member is moved int the direction of withdrawal from the housing and thereby preventing movement of said hook portions to their flexed positions.

In accordance with the present invention, retaining means represented generally by numeral 48 in FIG. 5 are provided to prevent the inadvertent or accidental movement of the hook portions 20, 20 to their flexed positions when latch plate 16 is engaged within housing 32. In this regard, it has been found that when the clasp 10 is fastened and the necklace N or other article is placed in position for normal use, there is a force exerted on the clasp urging latch member 12 and keeper member 14 in opposite directions. In other words, latch plate 16 and housing 32 may be considered as being under tension when the clasp 10 is fastened as illustrated in FIG. 5. It is to be noted that when the clasp members are under tension, the hook portions 20, 20 each terminate in an end portion overlying a separate edge portion of the housing side walls 36, 36 forming the periphery of the apertures 44, 44 to prevent movement of the hook portions 20, 20 to their flexed positions. Stated otherwise, each of the outwardly projecting hook portions 20, 20 may be considered as forming an open-ended passage between said hook portion and the latch plate 16. Thus, when the clasp members are fastened and under tension, an edge portion of the housing wall defining the aperture is received in the open-ended passage. The overlying relation of the hook end portions to the housing side walls when the clasp members are engaged and under tension serves to prevent the hook portions 20, 20 from moving to their flexed positions to inadvertently or accidentally unfasten the clasp.

At such time as it is desired to unfasten the clasp 10, the latch plate 16 is again moved forwardly within the housing 32, as represented by the arrow in FIG. 5, until the hook portions 20, 20 are aligned with the apertures 44, 44 in the housing side walls 36, 36. The hook portions 20, 20 may then be digitially depressed and moved to their flexed positions, as shown in FIG. 6, permit the latch plate 16 to be withdrawn through the open front end 42 of the housing as shown in FIG. 7.

Figure 9:
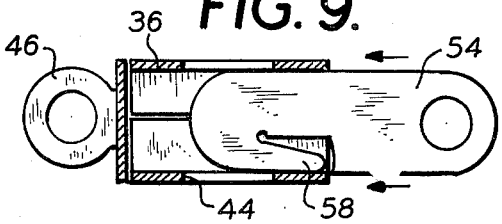

FIGS. 8–11 illustrate another embodiment of the invention represented generally by numeral 50 which incorporates a modified latch member 52 disposed for engagement with a keeper member 14 identical tothe keeper member illustrated and described in connection with the embodiment of FIGS. 1–7. Latch member 52 is essentially similar to latch member 12 in that it represents a thin plate 54 formed having a forwardly insertable end portion 56 and a single resiliently depressible hook portion 58 projecting outwardly from the plate and extending rearwardly of end portion 56. Hook portion 58 is located in the plane of plate 54 and projects outwardly beyond a side edge 60 of said plate when the hook portion is in its normally extended position. Hook portion 58 is disposed for movement from a normally extended position to a flexed position in the direction of plate 54 as illustrated in FIG. 9. The side edge 60 of plate 54 is formed with a recess portion 62 to receive the hook portion 58 in its flexed position. In this regard, an arcuate cutout 63 is formed at the juncture of recess portion 62 and hook portion 58 to facilitate movement of said hook portion to its flexed position. Recess portion 62 may also be considered as defining a portion of the open-ended passage between hook portion 58 and plate 54. The rearwardly end portion 64 of plate 54 is formed with a through opening 66 for receiving a link or other suitable fastener for connecting the latch member 52 to one end of a necklace in conventional manner.

Figure 10:
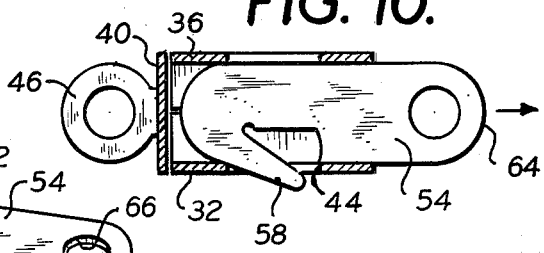
FIGS. 9, 10 and 11 are views corresponding to FIGS. 3, 4 and 5, respectively, substituting therein the embodiment of the latch member illustrated in FIG. 8.

The operation of clasp 50 is essentially the same as the operation earlier described in connection with clasp 10. For example, the forward end portion 56 of latch plate 54 is moved in the direction of the arrow in FIG. 9 and is inserted into the open front end 42 of the housing 32. Here again, the insertion of latch plate 54 within housing 32 causes the normally extended hook portion 58 to be moved toward its flexed position within the recess portion 62 of plate 54. The continued insertion of plate 54 within housing 32 permits the flexed hook portion 58 to be received within one of the apertured side walls 36, 36 of the housing whereupon the hook portion 58 is then free to move back to its normally extended position, as shown in FIG. 10, for fastening the clasp.

Figure 11:
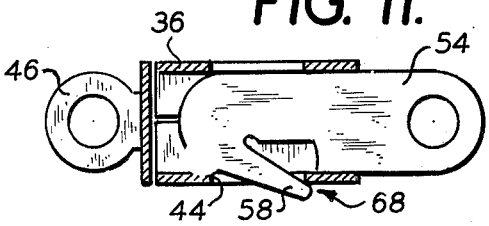

The retaining means of this embodiment are represented generally by numeral 68 in FIG. 11 wherein it is to be noted that, when the clasp members are under tension, the hook portion 58 terminates in an end portion overlying one an edge portion one of the housing side walls 36 forming the periphery of the associated aperture 44 to prevent movement of the hook portion 58 to its flexed position. The overlying relation of the hook end portion to the housing side wall when the clasp members are engaged and under tension serves to prevent the hook portion 58 from moving to its flexed position to inadvertently or accidentally unfasten the clasp.

In order to unfasten clasp 50, latch plate 54 must first be moved forwardly within the housing 32 until the hook portion 58 is aligned with the aperture 44 in the housing side wall 36. The hook portion 58 may then be digitally depressed and moved to its flexed position to permit the latch plate 54 to be withdrawn through the open front end 56 of the housing.

FIGS. 12–18 illustrate another embodiment of the invention represented generally by numeral 70 which incorporates modified latch member and keeper member 72 and 74, respectively, manufactured and constructed similar to the corresponding members of clasp 10 illustrated and described in connection with the embodiment of FIGS. 1–7. Latch member 72 represents a thin latch plate 76 formed having a forwardly insertable end portion 78, a raised arcuate portion 80 and a rearwardly end portion 82. A resiliently depressible hook portion 84 projects outwardly from the raised portion 80 and extends rearwardly of forward end portion 78 to form an open-ended passage between hook portion 84 and plate 76. Hook portion 84 is stamped out of the material constituting the raised arcuate portion 80 thereby defining an opening 86 located to receive hook portion 84 when it is depressed. In this regard, hook portion 84 is disposed for movement from a normally extended position to a flexed position in the direction toward plate 76 as indicated in FIGS. 14 and 15. The angular relationship $\beta$ of hook portion 84 to the plane of the forward end portion 78 is approximately 30°. The rearward end portion 82 of plate 76 is formed with a through opening 86 for receiving a link or other suitable fastener for connecting latch member 72 to one end of an article in conventional manner.

Keeper member 74 represents a thin walled housing 88 having a top wall 90, a pair of opposed side walls 92,

92, a split bottom wall 94, a rear wall 96 and an open front end 98 for receiving the latch member 72 in the manner hereinafter described. Housing top wall 90 is formed having an elongated aperture or opening 100 having suitable dimensions and located to receive hook portion 84 engaging the latch plate 72 without housing 88. The rear wall 96 terminates in an angular ring-like portion 102 projecting outwardly from wall 96 in the direction opposite to front end 98, and in a plane substantially parallel to the plane of top wall 90. Ring portion 102 receives a link or other suitable fastener for connecting keeper member 74 to the other end of the article in conventional manner.

In fastening the clasp 70, the forward end portion 78 of latch plate 76 is moved in the direction of the arrow shown in FIG. 13 and inserted into the open front end 98 of the housing 88. Here again, as noted in connection with the previous embodiments, the open end of the housing has a smaller dimension than the corresponding dimension of the latch plate when the hook portion is in its extended position. Thus, insertion of latch plate 76 within housing 88 causes the normally extended hook portion 84 to be moved toward its flexed position as shown in FIGS. 14 and 15. The continued insertion of plate 76 within housing 88 permits the flexed hook portion 84 to be received within the apertured top wall 90 of the housing whereupon the hook portion 84 is then free to move back to its normally extended position, as shown in FIG. 16, for fastening the clasp. The configuration of hook portion 84 and the dimensions of top wall aperture 100 are such that the terminal end of hook portion 84 extends beyond top wall aperture 100 when latch plate 76 is engaged within housing 88. Thus, when latch member 72 is now moved in the direction of withdrawal from keeper member 74, latch plate 76 is prevented from being completely withdrawn from housing 88 by means of the extended hook portion 84 which projects beyond the top wall aperture 100.

The retaining means of this embodiment are represented generally by numeral 104 in FIGS. 17 and 18 wherein it is to be noted that, when the clasp members 72 and 74 are under tension, the hook portion 84 terminates in a downwardly and rearwardly projecting end portion 105 overlying an edge portion of housing top wall 90 forming the periphery of aperture 100 to prevent movement of hook portion 84 to its flexed position. In other words, when the clasp members are fastened and under tension, the edge portion of the housing wall defining the aperture is received in the open-ended passage formed between the hook portion 84 and the latch plate 76. The overlying relation of the hook end portion 105 to the housing top wall when the clasp members are engaged and under tension serves to prevent the hook portion 84 from moving to its flexed position to inadvertently or accidentally unfasten the clasp.

In order to unfasten clasp 70, latch plate 76 must first be moved forwardly within the housing 88 until the hook portion 84 is aligned with the aperture 100 in the housing top wall 90. The hook portion 84 may then be digitally depressed and moved to its flexed position to permit the latch plate 76 to be withdrawn through the open front end 98 of the housing.

FIGS. 19–25 illustrate another embodiment of the invention represented generally by numeral 110 which incorporates modified latch member and keeper member 112 and 114, respectively, manufactured and constructed similar to the corresponding members of clasp 70 illustrated and described in connection with the embodiment of FIGS. 12–18. Latch member 112 represents a latch plate 116 formed having a forwardly insertable end portion 118, and a rearwardly end portion 120. A resiliently depressible hook portion 122 projects outwardly from the upper surface of plate 116 and is located intermediate the end portions. Hook portion 122 extends rearwardly of forward end portion 118 and is stamped out of the material constituting the latch plate 116 thereby defining an opening 124 located to receive hook portion 122 when it is depressed. As noted in connection with the previous embodiments, hook portion 122 is disposed for movement from a normally extended position to a flexed position in the direction toward plate 116 as indicated in FIG. 22. The rearward end portion 120 of plate 116 is formed with a through opening 126 for receiving a link or other suitable fastener for connecting latch member 112 to one end of an article in conventional manner.

Keeper member 114 represents a thin walled housing 128 having a top wall 130, a pair of opposed side walls 132, 132, a split bottom wall 134, a rear wall 136 and an open front end 138 for receiving the latch member 112 in the manner hereinafter described. Housing top wall 130 is formed having an elongated aperture or opening 140 having suitable dimensions and located to receive the hook portion 122 for engaging the latch plate 116 within housing 128. The rear wall 136 terminates in an angular ring-like portion 142 projecting outwardly from wall 136 in the direction opposite to front end 138. Ring portion 142 receives a link or other suitable fastener for connecting keeper member 114 to the other end of the article in conventional manner.

Housing 148 further includes a pair of laterally spaced resilient guide portions 144, 144 struck from the split bottom wall 134, 134 and projecting inwardly of the housing 128. Guide portions 144, 144 are each preferably of an inverted V-shaped having its apex centrally located beneath and spaced from the top wall aperture 140. Guide portions 144, 144 are of spring-like construction and are disposed for movement from a normally extended position to a depressed position upon insertion of latch plate 116 within housing 128.

In fastening the clasp 110, the forward end portion 118 of latch plate 116 is moved in the direction of the arrow shown in FIG. 20 and inserted into the open front end 138 of the housing 128. The insertion causes the forward end portion 118 to come in contact with the guide portions 144, 144 whereupon the latch plate 116 is inclined to permit the front end portion to ride up one side of the guide portions as noted in FIG. 21. The continued insertion of latch plate 116 within housing 128 causes the normally extended hook portion 84 to be moved toward its flexed position and causes the guide portions 144, 144 to be displaced to their depressed positions as shown in FIG. 22. In this regard the guide portions 144, 144 regard, a force on latch plate 116 urging said plate in the direction of the housing top wall 130. The continued insertion of latch plate 116 permits the flexed hook portion 122 to be received within the apertured top wall 130 of the housing whereupon the guide portions 144, 144 and the hook portion 122 are then free to move back to their normally extended positions, as shown in FIG. 23, wherein the hook portion 122 projects beyond the top wall aperture 140 when the clasp is fastened. Guide portions 144, 144 thus function as positioning elements to maintain latch plate 116 in a substantially parallel position to housing top wall 130 when said latch plate is engaged within housing 128. The configuration of hook portion 122 and the dimensions of top wall aperture 140 are such that the terminal end of hook portion 122 extends beyond top wall aperture 140 when latch plate 116 is engaged within housing 128. Thus, when latch member 112 is now moved in the direction of withdrawal from keeper member 114, as shown in FIG. 23, latch plate 116 is prevented from being completely withdrawn from housing 128 by means of the extended hook portion 122 which projects beyond the top wall aperture 140.

The retaining means of this embodiment are represented generally by numeral 146 in FIG. 24 wherein it is to be noted that, when the clasp members 112 and 114 are under tension, the hook portion 122 terminates in a downwardly and rearwardly projecting end portion 147 overlying an edge portion of housing top wall 130 forming the periphery of aperture 140 to prevent movement of hook portion 122 to its flexed position. As noted in connection with the previous embodiments, when the clasp members are fastened and under tension, the edge portion of the housing wall defining the aperture is received in the open-ended passage formed between the hook portion 122 and the latch plate 116. The overlying relation of the hook end portion 147 to the housing top wall when the clasp members are engaged and under tension serves to prevent the hook portion 122 from moving to its flexed position to inadvertently or accidentally unfasten the clasp.

Here again, as noted in connection with the previous embodiments, clasp 110 is unfastened by first moving latch plate 116 forwardly within the housing 128 until the hook portion 122 is aligned with the aperture 140 in the housing top wall 130. The hook portion 122 may then be digitally depressed and moved to its flexed position which also serves to displace guide portions 144, 144 to their depressed positions. Such movement serves to disengage the close members and permits the latch plate 116 to be withdrawn through the open front end 138 of the housing.

It is apparent from the Figures of the various embodiments and the descriptions thereof that, with respect to each of said embodiments, the length of the housing beyond the apertured wall is greater than the length of the latch plate received in said housing when the hook end portion overlies the edge portion of said housing wall defining said aperture to permit additional movement of the latch plate relative to the housing in the direction of insertion. Such relative movement permits the clasp to be unfastened in the manner heretofore described.

There is thus provided various clasps each having improved locking or retaining means for securely fastening the separable members of the clasp to prevent the accidental disengagement thereof, and which clasps are relatively simple in construction and economical to manufacture.

While preferred embodiments of the invention have been shown and described in detail, it will be readily understood and appreciated that numerous omissions, changes and additions may be made without departing from the spirit and scope of the present invention.

We claim:

1. A clasp for an article of jewelry comprising:

a. a thin latch member having a forwardly insertable end portion and a resiliently depressible hook portion projecting outwardly from said latch member to form an open-ended passage between said hook portion and said latch member, said hook portion extending rearwardly of said insertable end portion and being disposed for movement from a normally extended position to a flexed position in the direction toward said latch member;

b. a keeper member having thin spaced walls defining an opening of smaller dimension than the corresponding dimension of said latch member when said hook portion is in its extended position and through which the latch member may be inserted or withdrawn when said hook portion is in its flexed position;

c. retaining means positioned at a pre-selected location on said keeper member engageable with said hook portion upon insertion of said latch member to permit said hook portion to move to its extended position for fastening said clasp;

d. said retaining means comprising an edge portion of at least one of said walls located adjacent said hook portion when said clasp is fastened;

e. said hook portion being sized to extend beyond said edge portion when said latch member and said keeper member are engaged and to receive said edge portion in said open-ended passage when said engaged latch member is moved in the direction of withdrawal from said keeper member to prevent movement of said hook portion to its flexed position;

f. said keeper member extending beyond said retaining means a distance greater than the length of said latch member received therein when said hook portion is engaged with said retaining means and extends beyond said edge portion thereof to permit additional movement of said latch member relative to said keeper member in the direction of insertion;

whereby said clasp is unfastened by moving said latch member in the direction of insertion in said keeper member to disengage said hook portion from said retaining means and then moving said hook portion to its flexed position to permit said latch member to be withdrawn through the opening in said keeper member.

2. The clasp as recited in claim 1, wherein said retaining means further comprises said one of said walls formed having an aperture to receive said hook portion for engaging said latch member with said keeper member; said edge portion of said one wall corresponding to an edge portion defining said aperture; and said hook portion terminating in an end portion extending through said aperture and overlying said edge portion when said engaged latch member is moved in the direction of withdrawal from said keeper member.

3. The clasp as recited in claim 2, wherein said latch member comprises a thin plate having a side edge; said hook portion located in the plane of said plate with the hook end portion projecting outwardly beyond the side edge of said plate when said hook portion is in its extended position.

4. The clasp as recited in claim 3, wherein the side edge of said plate has a recessed portion defining said open-ended passage sized to receive said hook portion in its flexed position.

5. The clasp as recited in claim 2, wherein said latch member comprises a thin plate having an upper surface; said hook portion projecting outwardly from said upper surface.

6. The clasp as recited in claim 5, wherein the upper surface of said plate has a raised portion; said hook portion projecting outwardly from said raised portion.

7. A clasp for an article of jewelry or the like comprising:

a. a thin latch plate having a forwardly insertable end portion and a resiliently depressible hook portion projecting outwardly from said plate to form an open-ended passage between said hook portion and said plate, said hook portion extending rearwardly of said insertable end portion and being disposed for movement from a normally extended position to a flexed position in the direction toward said plate;

b. a thin walled housing having an open end of smaller dimension than the corresponding dimension of said latch plate when said hook portion is in its extended position and through which the hook portion of said plate may be inserted or withdrawn when said hook portion is in its flexed position, said housing having an apertured wall located to receive said hook portion upon insertion thereof for engaging said latch plate within said housing and permitting said hook portion to move to its extended position for fastening said clasp;

c. said hook portion being sized to extend beyond the aperture in said housing wall when said latch plate is engaged within said housing;

d. said hook portion terminating in an end portion overlying an edge portion of the housing wall defining said aperture and receiving said edge portion in said open-ended passage when said engaged latch plate is moved in the direction of withdrawal from said housing to prevent movement of said hook portion to its flexed position;

e. the length of said housing beyond said apertured wall being greater than the length of said latch plate received therein when said hook end portion overlies the edge portion of said housing wall defining said aperture to permit additional movement of said latch plate relative to said housing in the direction of insertion;

whereby said clasp is unfastened by moving said latch plate in the direction of insertion in said housing to align said hook portion with said aperture and then moving said hook portion to its flexed position to permit said latch plate to be withdrawn through the open end of said housing.

8. The clasp as recited in claim 7, wherein said latch plate has a side edge; said hook portion being located in the plane of said plate with the hook end portion projecting outwardly beyond the side edge of said plate when said hook portion is in its extended position.

9. The clasp as recited in claim 8, wherein the side edge of said latch plate has a recessed portion defining said open-ended passage sized to receive said hook portion in its flexed position.

10. The clasp as recited in claim 7, wherein said plate has an upper surface; said hook portion projecting outwardly from said upper surface.

11. The clasp as recited in claim 10, wherein said housing includes a resiliently depressible guide portion located within said housing and spaced from said apertured wall, said guide portion disposed for movement from a normally extended position to a depressed position; said latch plate engaging and displacing said guide portion to its depressed position upon insertion of said hook portion within said housing whereby said guide portions moves to its extended position and exerts a force on said latch plate in the direction of said apertured wall when said hook portion extends beyond the aperture in said housing wall.

12. The clasp as recited in claim 10, wherein the upper surface of said latch plate has a raised portion; said hook portion projecting outwardly from said raised portion.

* * * * *